US007753058B2

(12) United States Patent
Chudzik et al.

(10) Patent No.: US 7,753,058 B2
(45) **Date of Patent: *Jul. 13, 2010**

(54) HAIR RETAINING CLIP WITH ELASTIC BIASING MEMBER

(75) Inventors: Stan Chudzik, Marietta, GA (US); Michael Defenbaugh, Marietta, GA (US); Sarah Kraft, Atlanta, GA (US); Ping Chiu Lau, Kowloon Bay (CN)

(73) Assignee: Goody Products, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/302,647

(22) Filed: Dec. 14, 2005

(65) Prior Publication Data

US 2007/0131238 A1 Jun. 14, 2007
US 2009/0183752 A9 Jul. 23, 2009

Related U.S. Application Data

(63) Continuation-in-part of application No. 11/272,996, filed on Nov. 14, 2005, now Pat. No. 7,305,996.

(60) Provisional application No. 60/628,148, filed on Nov. 16, 2004.

(51) Int. Cl.
*A45D 8/00* (2006.01)
*A45D 8/20* (2006.01)

(52) U.S. Cl. ..... 132/277; 132/276

(58) Field of Classification Search ..... 132/273–275, 132/276, 277, 279; 24/499, 500, 511; 428/375, 428/377, 392, 394

See application file for complete search history.

(56) References Cited

U.S. PATENT DOCUMENTS

| | | | | |
|---|---|---|---|---|
| 1,066,759 | A | 7/1913 | Schloss | |
| 1,533,380 | A | 4/1925 | Burkhart | |
| 2,030,610 | A * | 2/1936 | Randall | 57/225 |
| 2,661,748 | A | 12/1953 | Holder | |
| 2,767,721 | A | 10/1956 | Cockley | |
| 2,805,673 | A | 9/1957 | Solomon | 132/47 |
| 3,081,781 | A | 3/1963 | Stermer | 132/46 |
| 3,542,041 | A | 11/1970 | Mercorella | 132/46 |
| 3,590,830 | A | 7/1971 | Hannum | |
| 3,842,849 | A | 10/1974 | Goodman | 132/46 R |
| 4,513,063 | A | 4/1985 | Hashi et al. | |
| 4,557,503 | A | 12/1985 | Linn | 281/47 |
| 4,785,834 | A | 11/1988 | Gonzalez | 132/275 |
| 5,477,870 | A | 12/1995 | Menaged | |

(Continued)

FOREIGN PATENT DOCUMENTS

CN 2326038 Y 6/1999

(Continued)

*Primary Examiner*—Robyn Doan
(74) *Attorney, Agent, or Firm*—Gardner Groff Greenwald & Villanueva, PC

(57) ABSTRACT

A hair retaining clip including a first clip member, a second clip member, a hinge, an elastic member is disclosed. The first and second clip members each include a handle portion and a claw portion. The hinge is disposed between and pivotally connects the first and second clip members. An elastic member is disposed between and connects to the first and second clip members thereby biasing the claw portions of the respective first and second clip members together.

18 Claims, 6 Drawing Sheets

U.S. PATENT DOCUMENTS

| | | | | | |
|---|---|---|---|---|---|
| 5,535,765 | A | * | 7/1996 | Takashima | 132/273 |
| 5,638,836 | A | | 6/1997 | Yasuda | |
| 5,803,096 | A | | 9/1998 | Lee | 132/277 |
| D403,109 | S | * | 12/1998 | Potut | D28/40 |
| 5,862,815 | A | | 1/1999 | Murphy et al. | 132/277 |
| 5,996,593 | A | | 12/1999 | Horman | |
| 6,035,863 | A | * | 3/2000 | Mao | 132/273 |
| 6,135,125 | A | * | 10/2000 | Sartena | 132/275 |
| 6,257,251 | B1 | | 7/2001 | Burleson et al. | |
| 6,394,102 | B1 | | 5/2002 | Vogel | |
| 6,397,439 | B1 | * | 6/2002 | Langford | 24/518 |
| 6,439,242 | B1 | | 8/2002 | Head et al. | 132/273 |
| 6,453,911 | B1 | | 9/2002 | Silva | 132/275 |
| D485,644 | S | | 1/2004 | Winn et al. | |
| 6,681,778 | B1 | | 1/2004 | Salisbury et al. | 132/277 |
| 6,691,717 | B2 | | 2/2004 | Silva | 132/275 |
| 7,305,996 | B2 | * | 12/2007 | Kraft et al. | 132/273 |
| 2004/0065341 | A1 | | 4/2004 | La Fauci | |
| 2004/0149306 | A1 | * | 8/2004 | Rogers | 132/277 |
| 2004/0182411 | A1 | * | 9/2004 | Rogers et al. | 132/277 |
| 2006/0137707 | A1 | * | 6/2006 | Au | 132/273 |
| 2006/0157077 | A1 | * | 7/2006 | Kraft et al. | 132/200 |
| 2007/0028940 | A1 | * | 2/2007 | Coral | 132/277 |

FOREIGN PATENT DOCUMENTS

| | | | |
|---|---|---|---|
| WO | WO 2005025370 | A1 * | 3/2005 |

* cited by examiner

HAIR RETAINING CLIP WITH ELASTIC BIASING MEMBER

CROSS-REFERENCE TO RELATED APPLICATIONS

This application is a continuation in-part of U.S. patent application Ser. No. 11/272,996 filed Nov. 14, 2005 (now U.S. Pat. No. 7,305,996 issued Dec. 11, 2007), which claims the priority benefit of U.S. Provisional Patent Application Ser. No. 60/628,148 filed Nov. 16, 2004.

TECHNICAL FIELD

The present disclosure relates generally to a device for retaining strands of hair and, more particularly, to a retaining clip including an elastic member for biasing portions of the retaining clip together.

BACKGROUND OF THE DISCLOSURE

Retaining clips and, more specifically, claw clips for holding or retaining strands of hair during hair care or hair styling are widely used and have been around for many years.

One such example of a retaining clip is shown in United States Patent application No. 2004/0065341. This application discloses a jaw hair clip for firmly holding hair. The jaw hair clip includes a first jaw portion pivotally attached to a second jaw portion via a hinge. The first and second jaw portions are biased together by a spring disposed on the hinge. Rubber or soft plastic beading is formed on at least one of the first or second jaw portions to soften the pressure applied to the hair, while minimizing slippage.

Another example of a retaining clip is shown in United States Patent application No. 2004/0149306. This application discloses a hair holding device with an elastic closure operation. The hair holding device includes first and second body members pivotally connected via a hinge. Each of the body members includes a hair gripping portion for engaging strands of hair. The first and second body members are biased together with a spring disposed at the hinge. The first and second body member include at least one elastomeric member for biasing the first and second body members together once the hair holding device is in a closed position.

These and similar retaining clips, however, lack durability due to the biasing spring located at the hinge portion of the respective retaining clips, and sometimes lack the desired hair gripping capability provided by the spring.

SUMMARY OF THE DISCLOSURE

In accordance with one aspect of the disclosure, a reliable and durable hair retaining clip for retaining a bundle of hair is disclosed. The retaining clip includes first and second clip members each having a handle portion and a claw portion. A hinge is disposed and pivotally connects the first and second clip members. An elastic member is disposed between and attaches to each of the first and second clip members. The elastic member biases the first and second claw portions together to a normal closed position.

In accordance to another aspect of the disclosure, a hair clip for retaining a bundle of hair including a first clip member, a second clip member, a hinge, and an elastic member is disclosed. Each of the first and second clip members include a first end having a handle portion and a second end having a claw portion. The hinge is disposed between and pivotally connects the first and second clip members. The elastic member is disposed between the first and second clip members. The bundle of hair is received by an area defined by the elastic member and the first and second claw portions.

In accordance with another aspect of the disclosure, a hair clip for retaining a bundle of hair including a first half, a second half, a hinge and an elastic member is disclosed. The first and second halves of the hair clip each include a handle and a claw. The hinge pivotally connects the first and second halves of the hair clip. The elastic member is disposed between the first and second halves so that the claws of the first and second halves abut a first portion of the bundle of hair and the elastic member abuts a second portion of the bundle of hair.

Figure 1:
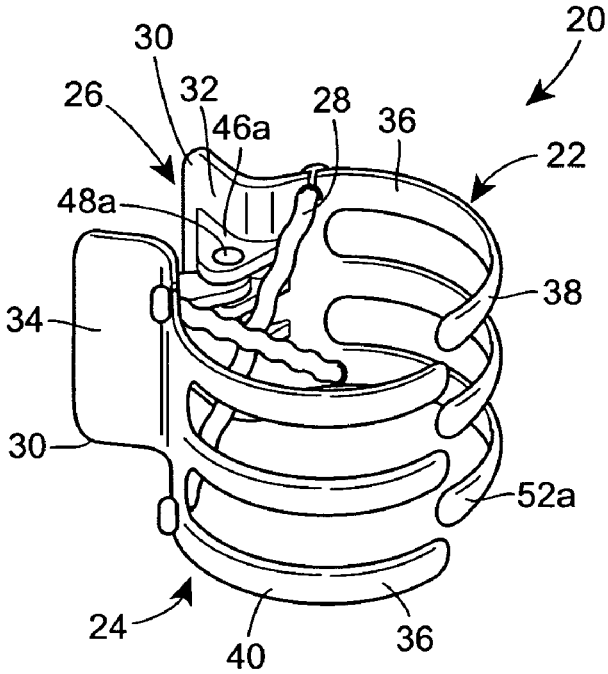
FIG. 1 is an exploded isometric view of a hair retaining clip in a generally closed position according to one embodiment of the disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the claims.

DETAILED DESCRIPTION

Figure 2:
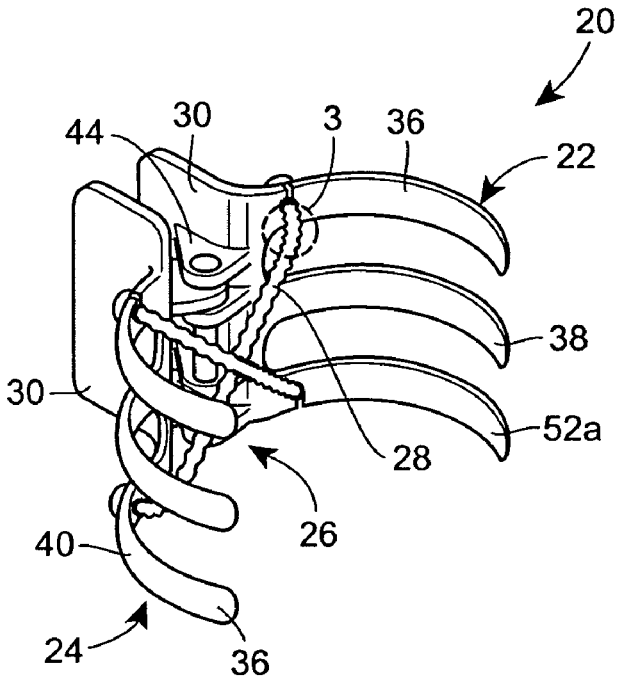
FIG. 2 is an isometric view of the hair retaining clip of FIG. 1 in a generally open position.

Referring now to the drawings and with specific reference to FIGS. 1 and 2, a hair retaining clip constructed in accordance with the teachings of the disclosure is generally depicted by reference numeral 20. As shown therein, the clip 20 in this exemplary embodiment, includes a first half or first clip member 22, a second half or second clip member 24, a hinge 26, and an elastic member 28. The first and second clip members 22, 24 are pivotally connected via the hinge 26 near a handle 30 of the clip 20. The handle 30 includes a first handle portion 32 that is part of the first clip member 22, and a second handle portion 34 that is part of the second clip member 24. A claw or retaining portion 36 is disposed opposite the handle 30 on the clip 20. As with the handle 30, the claw 36 includes a first claw portion 38 that is part of the first clip member 22 and a second claw portion 40 that is part of the second clip member 24.

The first claw portion 38, as seen in FIGS. 1 and 2, includes and is defined by a plurality of fingers 52*a* that are at least partially curved or angled. Similarly, the second claw portion 40, includes and is defined by a plurality of fingers 52*b* that are at least partially curved or angled. Furthermore, the first and second clip members 22, 24 may include an intermediate connecting structure between the first and second handle portions 32, 34 and the first and second claw portions 38, 40 respectively. The elastic member 28 is disposed between and biases the first clip member 22 and the second clip member 24 together. Specifically, the elastic member 28 is connected to the hair clip 20 between the hinge 26 and the claw 36, and provides a biasing force to close the clip 20, thereby replacing the coil springs of previous clips that typically provide a bias at the hinge.

The clip 20, therefore, is opened or placed in an open position, as seen in FIG. 2, by forcing the first and second handle portions 32, 34 towards each other, thereby moving the first and second claw portions 38, 40 of the claw 36 apart. Similarly, as seen in FIG. 1, the resiliency of the elastic member 28, which is disposed between the first and second halves 22, 24 of the clip 20, will close or bias the claw 36 in a closed position.

The clip 20, as disclosed herein, may be used to retain strands of hair such as, for example, in a pony tail, but may be used in other fashions and manners that may or may not include the retention of hair.

The clip 20 and, more specifically, the first clip member 22, the second clip member 24, and at least portions of the hinge 26, may be constructed from a variety of materials, including, but not limited to wood, plastic, metal and composites. Preferably, however, the above components are constructed with a injection molding process using plastic materials such as ABS, polypropelene, high impact polystyrene, or the like.

Figure 3:
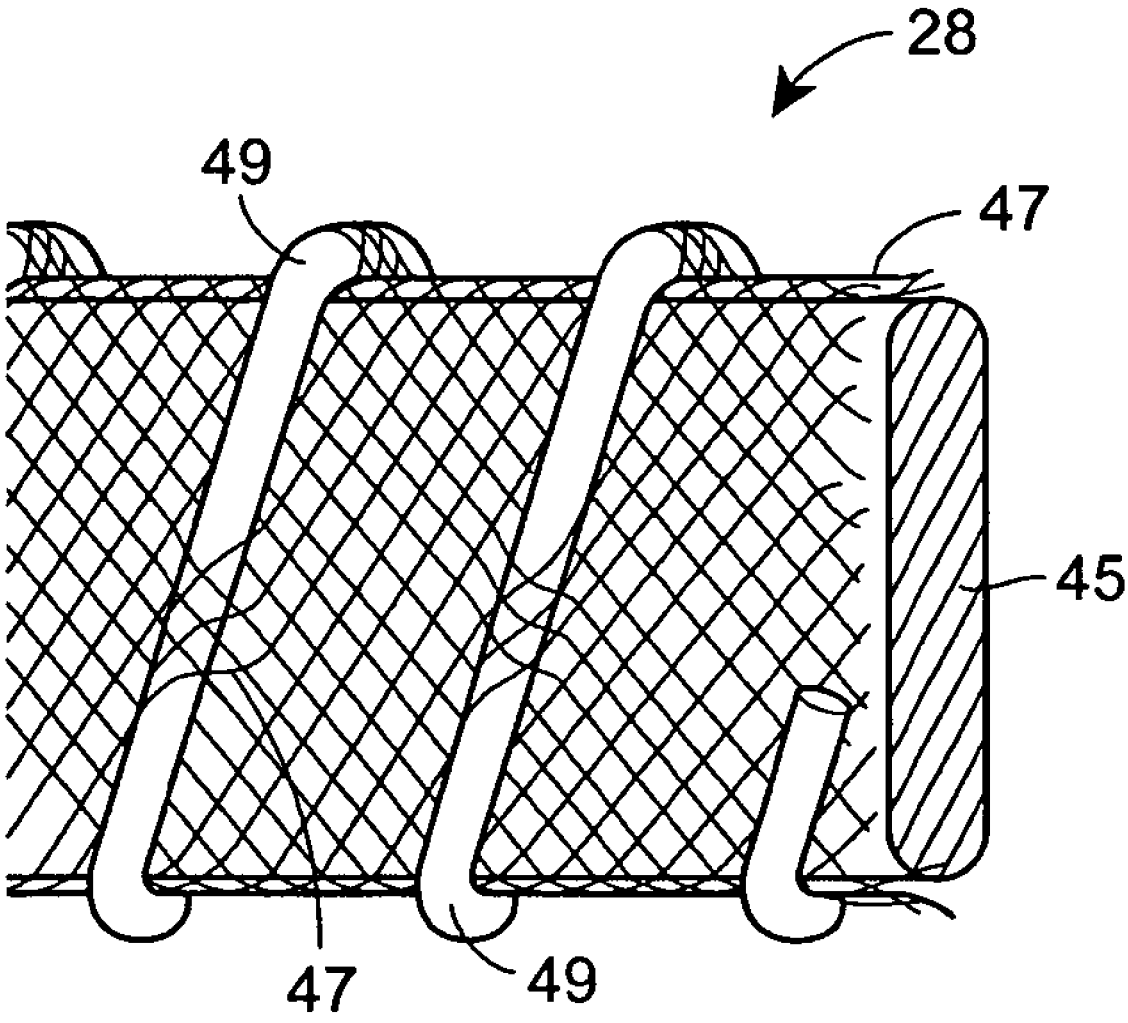
FIG. 3 is a cross-sectional view of an elastic member of detail 3 of FIG. 2.

The elastic member 28 may be constructed from a material including but not limited to plastic, rubber, natural rubber, silicone, or other elastic or viscoelastic materials. The elastic member 28 may form a continuous loop that may also contain breaks therebetween. The elastic member 28 may have a round cross-sectional area but may have other cross-sectional shapes, such as rectangular, oval, square, triangular, etc. In this exemplary embodiment, as illustrated in FIG. 3, the elastic member 28 includes a core 45 surrounded by and substantially enclosed by a sheath 47. The sheath 47 further includes a friction member 49 that may be part of the sheath 47 or is simply threaded there through. A more detailed description of this embodiment of the elastic member 28 can be found in U.S. Patent Application 60/628,148.

The first clip member 22, as best illustrated in FIGS. 1 and 2, includes the first handle portion 32 at one end and the first claw portion 38 at the other end. A first hinge portion 44 is disposed on the first clip member 22 and, more specifically, is disposed near the first handle portion 32. The first hinge portion 44 includes a plurality of tabs 46*a* having apertures 48*a* for receiving a pin 50. Similarly, the second member 24 includes the second handle portion 34 at one end and the second claw portion 40 at the other end. A second hinge portion 51 is disposed on the second clip member 24 and, more specifically, is disposed near the second handle portion 34. The second hinge portion 51 includes a plurality of protrusions 46*b* having apertures 48*b* for receiving the pin 50.

In this embodiment, the handle portions 32, 34 are each disposed at an angle relative to the claw 36, to provide room and leverage for opening the clip 20 via the handle 30. The first and second clip members 22, 24 are, therefore, substantially similar in structure. The first and second clip members 22, 24 differ, however, in that the spacing of some of the components are offset or misaligned to allow the clip 20 to operate and close. Specifically, as illustrated in FIGS. 1 and 2, the tabs 46*a* are offset relative to the tabs 46*b* such that the pin 50 can engage both the tabs 46*a* and 46*b*, and the fingers 52*a*, 52*b* are offset such that the claw 36 can close.

The elastic member 28, as seen in FIGS. 1 and 2, may be permanently or removably connected to the clip 20. In this exemplary embodiment, the elastic member 28 is secured by engaging the elastic member 28 with a plurality of slots 54*a* disposed on the first and second clip members 22, 24. Specifically, the slots 54*a* are disposed on outer edges of each of the first and second clip members 22, 24 such that the elastic member 28 can be inserted into the slots 54*a* without having to cut the elastic member 28, and thereby allowing easy replacement of the elastic member 28.

Figure 4:
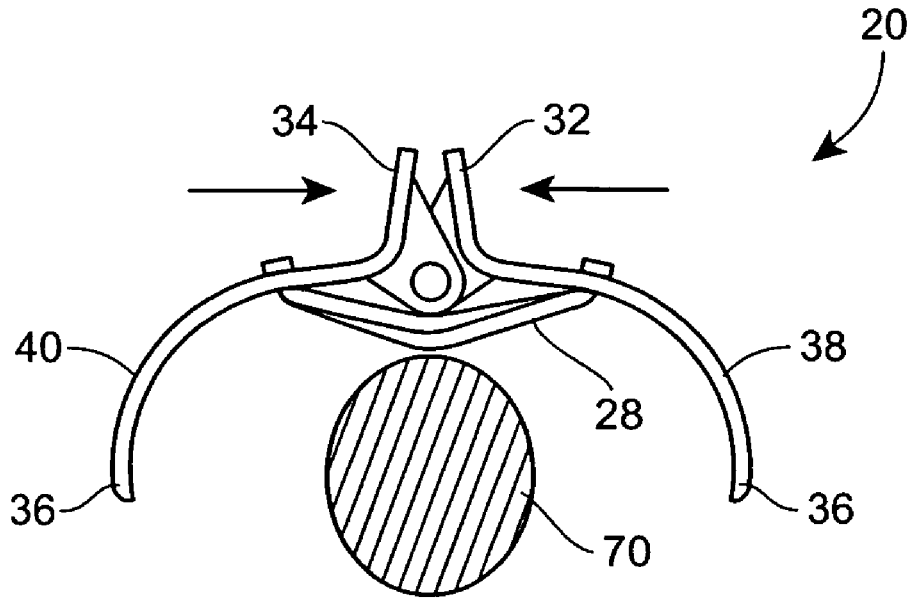
FIG. 4 is a side view of the hair clip of FIG. 1 in an open position ready to receive a bundle of hair.

An operation of the clip 20 will be herein described as retaining a bundle of hair 70, but it should be understood that the clip 20 may be used to retain, hold, or be disposed on a variety of objects in a variety of ways. In operation, as best illustrated in FIG. 4, a user may press the first and second handle portions 32, 34 towards each other, thereby opening the claw 36. The elastic member 28 is now in a taught state biasing the first and second claw portions 38, 40 of the claw 36 toward each other. Contemporaneously, the area defined by the claw 36 is separated by the elastic member 28 creating an upper and a lower area, as oriented in FIGS. 4 and 5. The lower of area is defined by the claw 36 and the elastic member 28, and receives the bundle of hair 70. The upper area is be defined by the claw 36 and the elastic member 28, but may also be defined by the handle 30.

Figure 5:
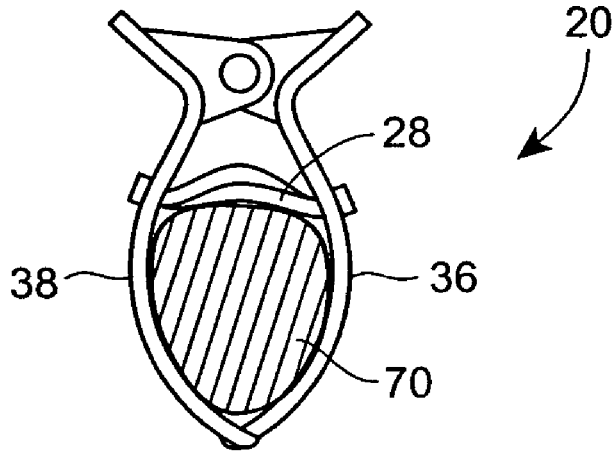
FIG. 5 is a side view of the hair clip of FIG. 1 in a closed position retaining a bundle of hair.

The clip 20, as illustrated in FIG. 5, is then engaged with the bundle of hair 70, by encompassing the bundle of hair 70 with the claw 36. As a result, an upper side of bundle of hair, as oriented in FIGS. 4 and 5, abuts a portion of the elastic member 28 and a lower side of bundle of hair 70 abuts the claw 36. As a result, the strands of hair that comprise the bundle of hair 70 are prevented from engaging the hinge 26 by virtue of the barrier created by the elastic member 28. This is another benefit of the hair clip 20, as it prevents the entanglement of the strands of hair with the hinge 26.

Figure 6:
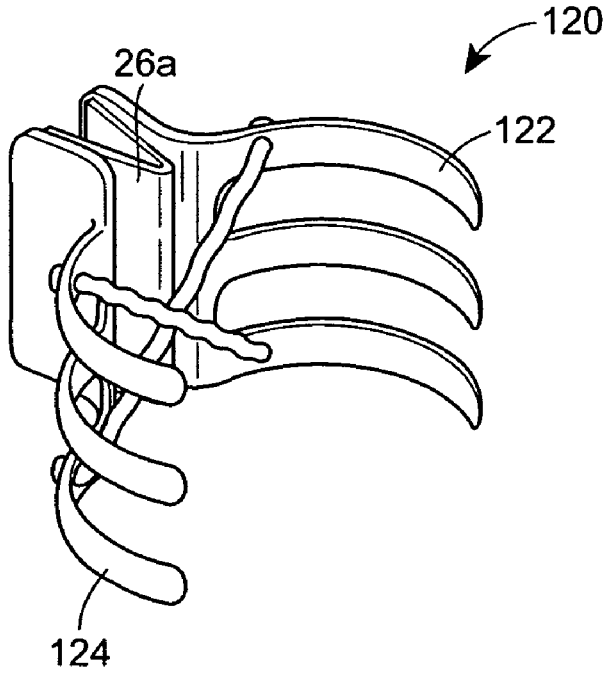
FIG. 6 is an isometric view of another embodiment of the hair retaining clip.
Figure 7:
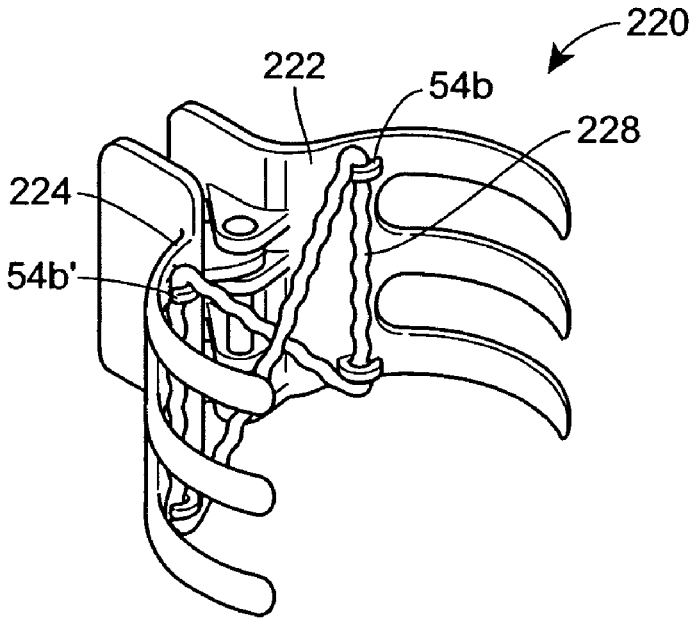
FIG. 7 is an isometric view of another alternate embodiment of the hair retaining clip.

The above exemplary embodiment may be varied or altered to achieve and create additional or alternative features. For example, as seen in FIG. 6, a clip 120 may include a living hinge 26*a* that may be attached to the clip 120 via glue, adhesive, or other attachment means. Alternatively, the living hinge 26*a* may be integrally molded in a one or multi step injection molding process with first and/or second members 122, 124. As seen in FIG. 7, a clip 220 may include hooks 54*b*' disposed on first and second clip members 222, 224 through which an elastic member 228 is disposed. As a result, the elastic member 228 may easily be removed or replaced due to the nature of the hook 54*b*' configuration. Alternatively, the clip 220 may include eyelets 54*b* disposed on the first and second clip members 222, 224.

Figure 8:
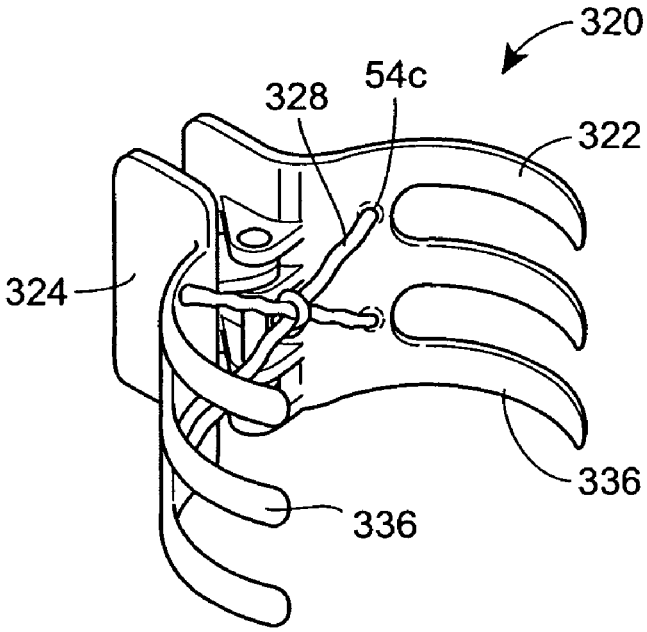
FIG. 8 is an isometric view of another alternate embodiment of the hair retaining clip.

A clip 320 may also include apertures 54*c* for receiving an elastic member 328, as illustrated in FIG. 8. In this exemplary embodiment, the elastic member 328 may be looped or threaded through the apertures 54*c* in the first and second members 322, 324. More specifically, the elastic member 328 may be looped through one of the apertures 54*c* in the first members 322 and through one or more of the apertures 54*c* in the second member 324, and then may be fasten to itself in an area defined by a claw 336 with a knot or other manner of connection known to those skilled in the art. Alternatively and/or additionally, the elastic member 328 may simply be threaded through one or more of the apertures 54*c* in the first and second members 322, 324 and then may be fasten on the other side of the first and second members 322, 324 with a button, knob, knot, or the like.

Figure 9:
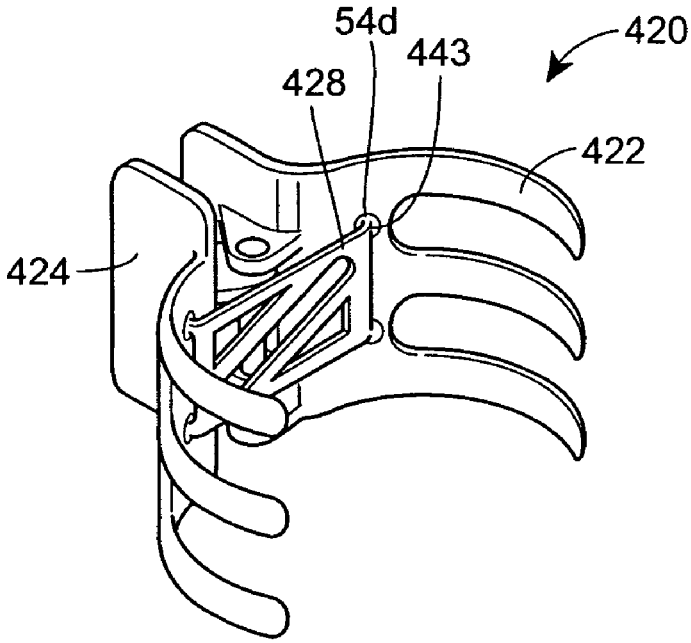
FIG. 9 is an isometric view of another alternate embodiment of the hair retaining clip.
Figure 10:
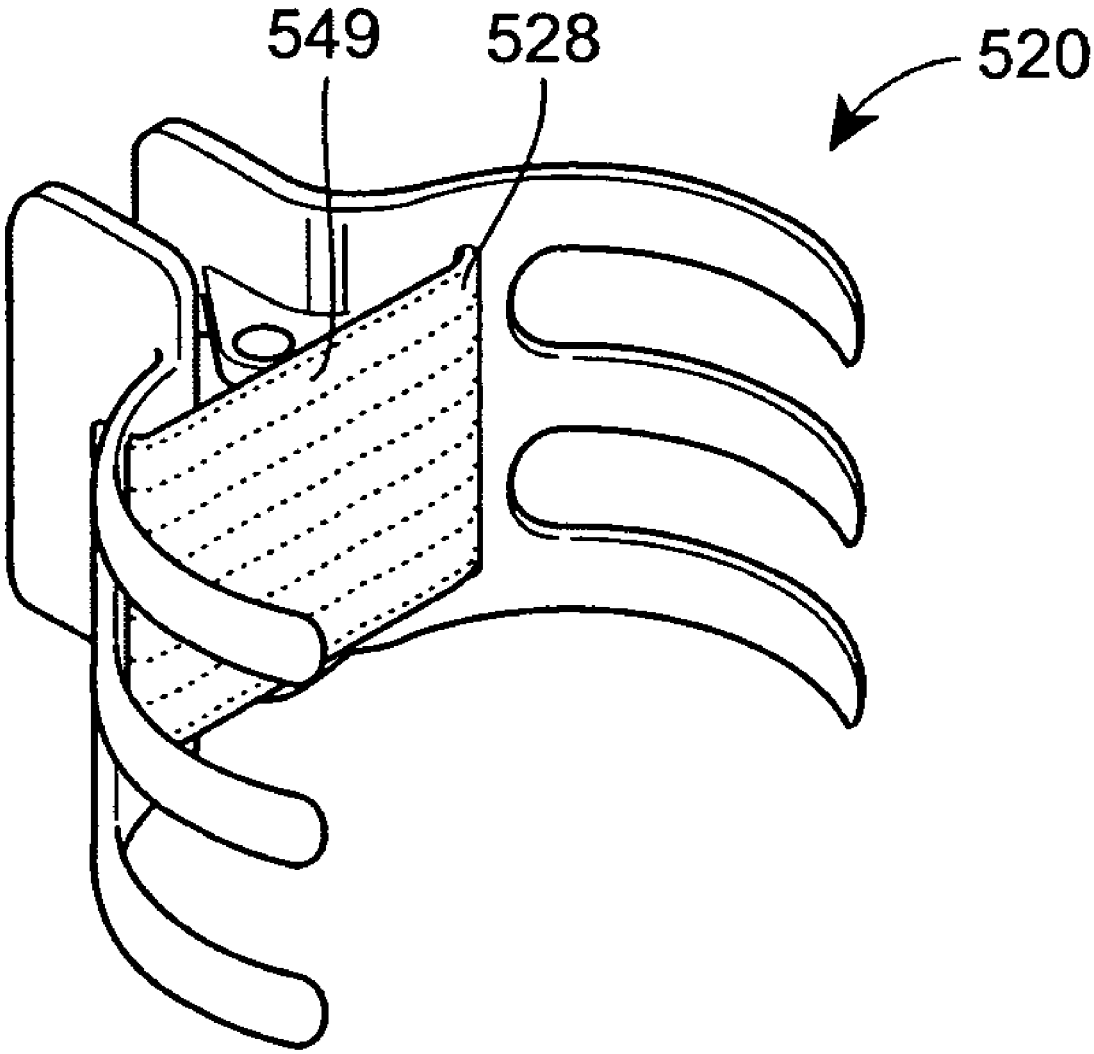
FIG. 10 is an isometric view of another alternate embodiment of the hair retaining clip.

The clip 20 may also include an elastic member 428 constructed from a thermal plastic elastomer (TPE) material, as seen in FIG. 9. The TPE web 428 may be molded into a clip 420 as part of a multiphase injection molding process. Specifically, the first and second clip members 422, 424 may include apertures 54*d* or similar structure for receiving the web 428. Additionally, the web 428 may include a stop or plug 443 to secure the web 428 in the first and second clip members 422, 424. A clip 520, as illustrated in FIG. 10, may also include an elastic member 528 comprising a woven elastic web having a friction member 549 as was described previously.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A hair retaining clip, comprising:

a first clip member including a handle portion and a claw portion;

a second clip member including a handle portion and a claw portion;

a hinge pivotally connecting the first and second clip members; and an elastic member disposed between and attached to each of the first and second clip members so that the elastic member biases the first and second claw portions to a normal closed position, wherein the elastic member comprises an elastic core, a sheath, and a friction member, the sheath is disposed a least partially around the core and has an outer surface, and the friction member is formed into the sheath such that at least a portion of the friction member is exposed through the outer surface of the sheath, wherein the outer surface of the sheath has a coefficient of friction and the friction member has a coefficient of friction that is greater than the coefficient of friction of the outer surface of the sheath.

2. The hair retaining clip of claim 1, further including at least one of a slot, a hook, and an aperture on the first clip member for receiving the elastic member.

3. The hair retaining clip of claim 1, further including at least two hooks, with a first one of the hooks disposed on the first clip member and a second one of the hooks disposed on the second clip member, wherein the elastic member is secured through each of the hooks.

4. The hair retaining clip of claim 1, further including at least two slots, with a first one of the slots formed in a first edge of the first clip member and a second one of the slots formed in a second edge the second clip member, wherein the elastic member is secured through each of the slots.

5. The hair retaining clip of claim 1, wherein the hinge includes a plurality of tabs having apertures and extending from each of the first and second clip members, and a plurality of pins disposed through the apertures.

6. The hair retaining clip of claim 1, wherein the hinge is a living hinge.

7. The hair retaining clip of claim 6, wherein the hinge and the first and second clip members are integrally formed.

8. The hair retaining clip of claim 1, wherein the core is elongate, the sheath is made of a woven material, the friction member is made of an elastic material, and the elastic friction member is woven or threaded into the sheath.

9. The hair retaining clip of claim 8, wherein the sheath is woven of a plurality of threads and the friction member is woven or threaded into the woven sheath such that the friction member replaces one or more of the sheath threads and, together with the threads, forms the sheath.

10. The hair retaining clip of claim 8, wherein the sheath is woven of threads having a cross-sectional area and the friction member has a cross-sectional area that is larger than the cross-sectional area of the threads of the sheath.

11. The hair retaining clip of claim 8, wherein the friction member is woven into the sheath such that the friction member abuts the core.

12. The hair retaining clip of claim 1, wherein the sheath surrounds the core entirely around its periphery and substantially along its length.

13. The hair retaining clip of claim 1, wherein friction member protrudes outwardly beyond the outer surface of the sheath.

14. A hair clip for retaining a bundle of hair, comprising:

a first clip member having a first end including a handle portion and a second end including a claw portion;

a second clip member having a first end including a handle portion and a second end including a claw portion;

a hinge disposed between and pivotally connecting the first and second clip members; and an elastic member disposed between the first and second clip members, wherein an area defined by the elastic member and the first and second claw portions receives the bundle of hair with the elastic member between the hair bundle and the hinge, wherein the elastic member comprises an elastic core, a woven fabric sheath that surrounds the elastic core, and a friction member woven or threaded into the fabric sheath such that at least a portion of the friction member is exposed through the outer surface of the fabric sheath, wherein the coefficient of friction of the friction member is greater than the coefficient of friction of the outer surface of the fabric sheath.

15. The hair clip of claim 14, wherein the elastic member biases the claw portions of the first and second clip members together.

16. The hair clip of claim 15, wherein the elastic member biases the handle portions of the first and second clip members apart.

17. The hair clip of claim 14, wherein the hinge is a living hinge.

18. The hair clip of claim 17, wherein the hinge and the first and second clip members are integrally formed.

* * * * *